United States Patent [19]

Clements

[11] 4,333,610

[45] Jun. 8, 1982

[54] GROOVED NOZZLE IRRIGATION SPRINKLER

[76] Inventor: Lloyd W. Clements, 49 W. Lincoln Ave. (C), Woodland, Calif. 95695

[21] Appl. No.: 167,236

[22] Filed: Jul. 10, 1980

Related U.S. Application Data

[63] Continuation of Ser. No. 29,369, Apr. 11, 1979, abandoned.

[51] Int. Cl.[3] ..... A62C 31/02

[52] U.S. Cl. ..... 239/601

[58] Field of Search ..... 239/DIG. 1, 601, 230, 239/590.5, 602, 590

[56] References Cited

U.S. PATENT DOCUMENTS

| | | | |
|---|---|---|---|
| 2,778,687 | 1/1957 | Hegstad | 239/601 |
| 2,946,517 | 1/1960 | Jacoby | 239/230 |
| 3,743,183 | 7/1973 | Malcolm | 239/230 X |
| 3,785,560 | 1/1974 | Hruby | 239/590.5 X |
| 3,884,416 | 5/1975 | King | 239/230 X |

*Primary Examiner*—Robert B. Reeves
*Assistant Examiner*—Gene A. Church
*Attorney, Agent, or Firm*—Klarquist, Sparkman, Campbell, Leigh, Whinston & Dellett

[57] ABSTRACT

The specification discloses an irrigation sprinkler of the impact arm type including a nozzle having a substantially cylindrical discharge passageway having four longitudinal grooves which are shallow and are V-shaped in transverse cross section. The grooves feather or turbulate the adjacent portions of the stream to cause, along with the action of the impact arm, very uniform application of water over the entire area of sprinkling.

11 Claims, 3 Drawing Figures

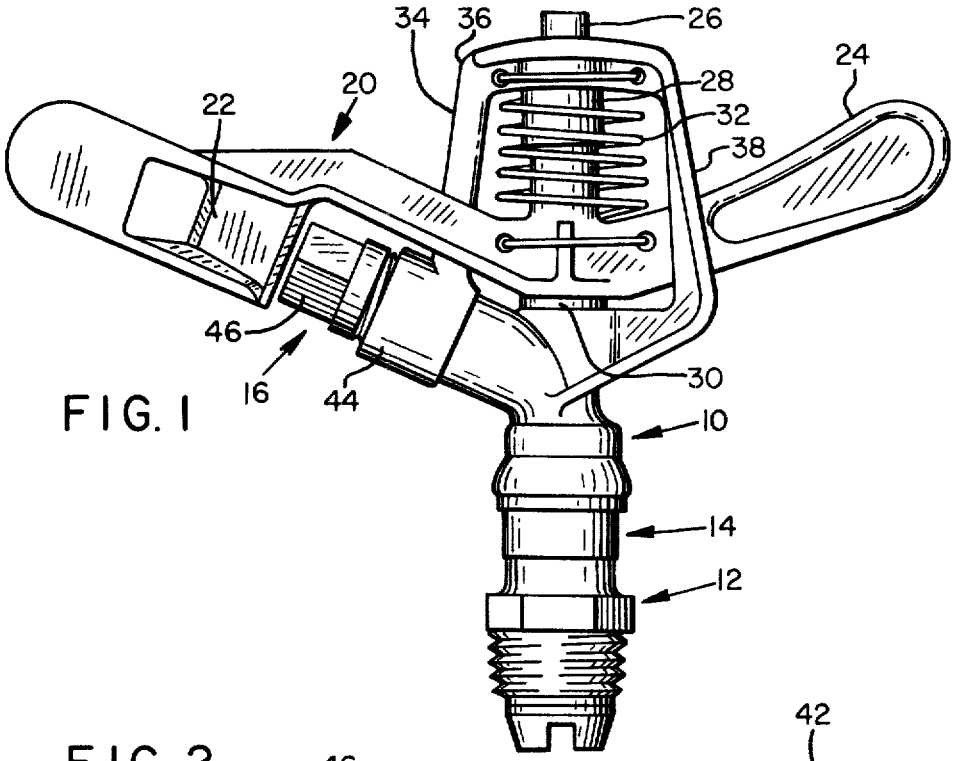
FIG. 1
FIG. 2
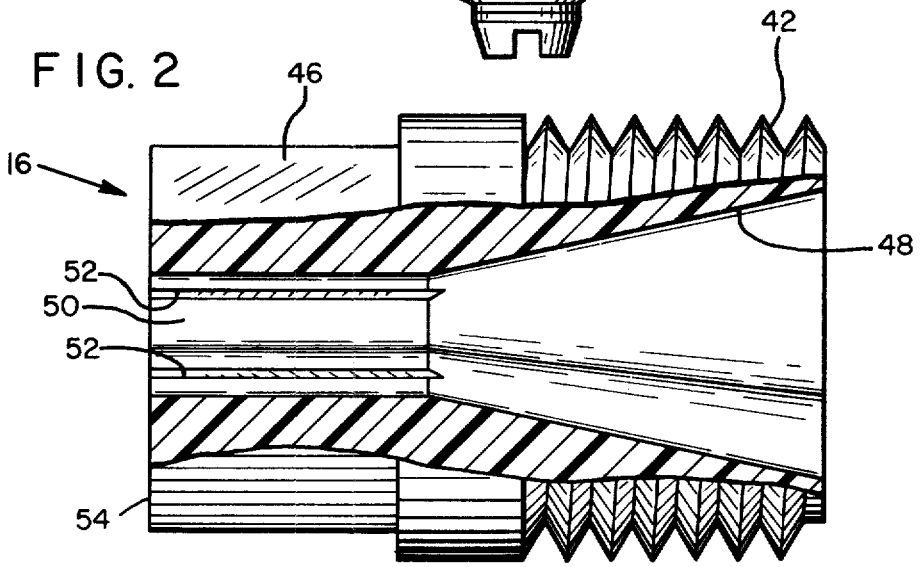
FIG. 3
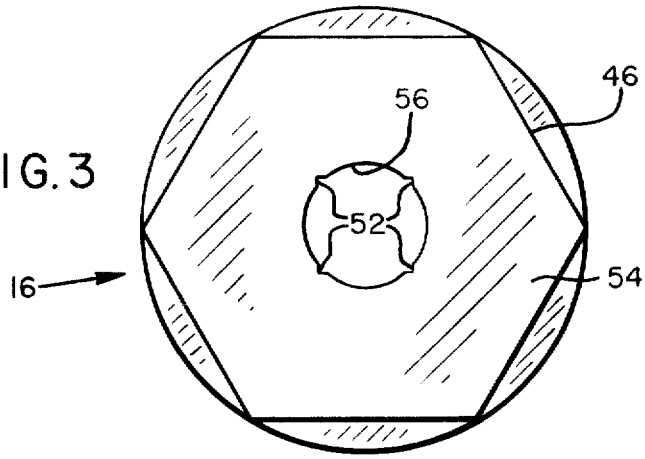

GROOVED NOZZLE IRRIGATION SPRINKLER

This is a continuation of application Ser. No. 029,369, filed Apr. 11, 1979, now abandoned.

BACKGROUND OF THE INVENTION

Irrigation sprinklers of the impact arm type, as for example, the sprinklers shown in U.S. Pat. Nos. 3,743,183 and 4,055,304, are extensively used. However, each sprinkler of this type known hitherto leaves a large annular area which is much dryer than the rest of the circle being sprinkled. The impact arm breaks up the stream of the sprinkler to provide better close-in coverage, but there still remains very poor coverage of the intermediate area.

OBJECTS

An object of the invention is to provide a grooved nozzle irrigation sprinkler.

Another object of the invention is to provide an impact arm irrigation sprinkler having greatly improved uniformity of distribution of water over the area sprinkled.

A further object of the invention is to provide a sprinkler having a nozzle with a substantially cylindrical discharge passageway having a plurality of shallow longitudinal grooves.

Another object of the invention is to provide an irrigation sprinkler having a nozzle comprising an elongated discharge passageway with a plurality of shallow longitudinal grooves which are V-shaped in transverse cross section and account for a small fraction of the total cross-sectional area of the discharge passageway.

DRAWINGS

FIG. 1 is an elevational view of a grooved nozzle irrigation sprinkler forming one embodiment of the invention;

FIG. 2 is an enlarged, partially sectional side elevation view of a grooved nozzle of the sprinkler of FIG. 1; and, FIG. 3 is an enlarged end view of the novel nozzle of FIG. 2.

A grooved nozzle irrigation sprinkler forming a specific embodiment of the invention includes a body 10 mounted rotatably on a bearing housing 12 by a resilient spring sleeve 14. A grooved nozzle 16 supplied with water under pressure from the body gives a very high coefficient of uniformity. The sprinkler is of the impact arm type and, except for differences brought out herein, is like that shown in U.S. Pat. No. 2,946,517. An arm 20 having a knife-edged impact plate portion 22 and a counter-balancing arm 24 is mounted for oscillation on a post 26 carried rigidly by the body between low friction thrust washers 28 and 30. A torsion spring 32, which is fixed at its upper end to an upper portion 36 of the body and at its lower end to the arms 20 and 24, biases the arm 20 toward engagement with a front face of a first vertical member 34 of the body and biases the arm 24 toward engagement with rear a face (hidden from view in FIG. 1) of a second vertical member 38 of the body.

The nozzle 16 has an externally threaded connecting portion 42 screwed sealingly into a tapped bore in angular, tubular portion 44 of the body 10. The nozzle has a hexagonal driving portion 46 adapted to receive a wrench (not shown) for installation and removal. The nozzle has a long, tapered or frustoconical fluid entrance passageway 48 and an elongated generally cylindrical discharge passageway 50 with four longitudinal, shallow grooves or diffuser channels 52 which preferably are spaced 90° apart and are coextensive with the cylindrical discharge passageway 50 and extend slightly into the entrance passageway 48. In use, the grooves 52 preferably are positioned in radial planes 45° to the vertical. The nozzle has a flat face 54 at its effluent end, the flat face lying in a radial plane such that the generally cylindrical discharge passageway 50 terminates in a generally circular orifice 56. The grooves cause four somewhat narrow and shallow stripes of feathered or turbulated water in the adjacent portions of the substantially cylindrical stream discharged by the nozzle. This, in effect, causes the stream to feather out slightly to distribute water in fine drops quite soon after leaving the nozzle, and then substantially continuously out to the outer end portion of the nozzle stream so there is a very high coefficient of uniformity. There would be, however, close in from the nozzle to about ten or so feet therefrom, substantially no water, if it were not for the periodic slight breaking of the stream by the impact arm 20. However, the impact arm, acting as usual in this type of sprinkler, very briefly and periodically breaks up the stream to cause good distribution in this close-in area.

The transverse V-shape of the grooves 52 and their shallowness prevents wedging of sand and debris in the grooves. The groove also act as stream straighteners, thus, the grooved nozzle 16 gives as long a discharge of its central jet as ungrooved nozzles of the prior art even while operating at substantially less pressure and has much higher coefficient of uniformity, even though operating at that lower pressure. For example, a coefficient of uniformity believed to be about 80–85 was achieved by the nozzle 16 with the sprinkler 10 supplied with water at thirty-five pounds per square inch, while ungrooved nozzles do not exceed a coefficient of uniformity of about 75 when operated at the same thirty-five pounds per square inch.

The "V" of each groove 52 preferably forms an included angle of about 90° and its depth may be about seven percent to nine percent of the diameter of the discharge passageway 50 for diameters of from 7/64ths to 3/16ths of an inch. Thus, the depth of each groove for a nozzle diameter of 7/64ths of an inch may be 0.007 of an inch; for a ⅛ inch nozzle diameter, 0.009 of an inch; for a 9/64 inch nozzle diameter, 0.011 of an inch; and for a 5/32 inch nozzle diameter, 0.014 of an inch. The total cross-sectional areas of the four grooves may be about two-and-one-half percent of the total cross-sectional area of the discharge passageway. The length of the discharge passageway 50 preferably is at least twice its diameter. The nozzle preferably is composed of a tough, high abrasion resistant material such as, for example, that sold under "VELOX" (a trademark of The General Electric Co.) or "DELRIN" (a trademark of E. I. Du Pont Co.). However, it may also be composed of brass.

What is claimed is:

1. In a sprinkler, a nozzle comprising:

a first portion having walls defining a generally frustoconical entrance passageway; and a second portion having walls defining a generally cylindrical elongated discharge passageway in streamlined fluid communication with the entrance passageway, the discharge passageway terminating in an orifice at an effluent end of the nozzle, the length of the discharge passageway being at least twice its diameter, the discharge passageway having a plurality of shallow longitudinal grooves in the walls thereof, the grooves being coextensive with the discharge passageway, the discharge passageway having a uniform transverse cross section of a predetermined area, the total cross-sectional area of the grooves being a small fraction of said predetermined area.

2. The nozzle of claim 1 wherein the entrance passageway is gradually tapered from a larger portion for receiving fluid from the sprinkler to a smaller portion contiguous with the discharge passageway and wherein the grooves extend slightly beyond the discharge passageway into the entrance passageway.

3. The nozzle of claim 1 wherein the grooves are uniform in size and shape relative to each other and are disposed in a radially symmetrical pattern.

4. The nozzle of claim 3 wherein the grooves are four in number and are located 90° from each other.

5. The nozzle of claim 3 wherein each groove is generally V-shaped in transverse cross section and forms an included angle of about 90°.

6. The nozzle of claim 3 wherein the discharge passageway has a predetermined diameter and each groove has a depth of about seven to nine percent of that diameter.

7. In an impact-arm irrigation sprinkler, a rotatable body;

a nozzle carried by the body and supplied with water therefrom, the nozzle having a generally cylindrical discharge passageway terminating in a generally circular orifice at an effluent end of the nozzle, the length of the discharge passageway being at least twice its diameter, the discharge passageway including a plurality of elongated shallow grooves spaced apart in the walls thereof, the grooves extending axially away from the orifice generally the full length of the discharge passageway, the discharge passageway having a predetermined cross-sectional area of which the grooves form a small fraction; and impact arm means periodically movable into and out of the stream discharged from the nozzle for rotating the body and for periodically interrupting the stream to water the area closely surrounding the body.

8. The sprinkler of claim 7 wherein the grooves are uniform in size and shape relative to each other and are disposed in a radially symmetrical pattern.

9. The sprinkler of claim 7 wherein the grooves are four in number and are located 90° from each other.

10. The sprinkler of claim 7 wherein each groove is generally V-shaped in transverse cross section and forms an included angle of about 90°.

11. The sprinkler of claim 7 wherein the discharge passageway has a predetermined diameter and each groove has a depth of about seven to nine percent of that diameter.

* * * * *